United States Patent [19]

Cheung

[11] Patent Number: 4,822,395

[45] Date of Patent: Apr. 18, 1989

[54] AIR SEPARATION PROCESS AND APPARATUS FOR HIGH ARGON RECOVERY AND MODERATE PRESSURE NITROGEN RECOVERY

[75] Inventor: Harry Cheung, Buffalo, N.Y.

[73] Assignee: Union Carbide Corporation, Danbury, Conn.

[21] Appl. No.: 203,264

[22] Filed: Jun. 2, 1988

[51] Int. Cl.[4] ..... F25J 3/04

[52] U.S. Cl. ..... 62/22; 62/24; 62/33; 62/41

[58] Field of Search ..... 62/9, 11, 22, 23, 24, 62/32, 33, 34, 41

[56] References Cited

U.S. PATENT DOCUMENTS

| | | | |
|---|---|---|---|
| 2,499,043 | 2/1950 | Voorhees | 62/175.5 |
| 2,817,216 | 12/1957 | Etienne | 62/123 |
| 2,824,428 | 2/1958 | Yendall | 62/22 |
| 3,079,759 | 3/1963 | Schilling | 62/22 X |
| 3,729,945 | 5/1973 | Petit | 62/22 |
| 4,137,056 | 1/1979 | Crelovko | 62/22 X |
| 4,222,756 | 9/1980 | Thorogood | 62/13 |
| 4,433,990 | 2/1984 | Olszewski | 62/22 |
| 4,453,957 | 6/1984 | Pahade et al. | 62/25 |
| 4,575,388 | 3/1986 | Okeda | 62/22 |
| 4,737,177 | 4/1988 | Erickson | 62/22 |
| 4,747,659 | 5/1988 | Gladmen et al. | 62/22 |

FOREIGN PATENT DOCUMENTS 1215377 12/1970 United Kingdom .

OTHER PUBLICATIONS

Latimer, R. E., Distillation of Air, Chemical Engineering Progress, Feb. 1967, pp. 35–59.

*Primary Examiner*—Steven E. Warner
*Attorney, Agent, or Firm*—Stanley Ktorides

[57] ABSTRACT

Process and apparatus to produce argon at high recovery with nitrogen at higher than conventional pressure comprising three columns wherein first column bottoms are passed into the second column, second column bottoms drive a third column top condenser, and argon-containing fluid is passed for separation into the third column from the second column at a point intermediate the points where first column bottoms enter and second column bottoms exit the second column.

20 Claims, 2 Drawing Sheets

AIR SEPARATION PROCESS AND APPARATUS FOR HIGH ARGON RECOVERY AND MODERATE PRESSURE NITROGEN RECOVERY

TECHNICAL FIELD

This invention relates generally to the cryogenic rectification of air and more particularly to the separation of air into its three major components.

BACKGROUND ART

The cryogenic separation of air is a well established industrial process. Cryogenic air separation involves the filtering of the feed air to remove particulate matter and compression of that clean air to supply the energy required for the separation. Following the air compression, the feed air stream is cooled and cleaned of the high boiling contaminants, such as carbon dioxide and water vapor, and then separated into its components by cryogenic distillation. The separation columns are operated at cryogenic temperatures to allow the gas and liquid contacting necessary for separation by distillation, and the separated products are then returned to ambient temperature conditions versus the cooling air stream.

When argon recovery is desired in addition to separation of the air into nitrogen and oxygen, a commonly used system is one employing three columns wherein the air is separated into nitrogen and oxygen in the first two columns, a higher pressure and lower pressure column, which are generally in heat exchange relation at a main condenser, and wherein an argon containing stream is passed from the lower pressure column into a third column for production of crude argon. A discussion of this conventional process is found in R. E. Latimer, "Distillation of Air", Chemical Engineering Progress, Volume 63, pages 35–59 (1967).

The conventional three component air separation process is generally suitable for many purposes but has a significant disadvantage if nitrogen recovery is desired at elevated pressure. Of the three primary components of air, nitrogen is the most volatile, argon has intermediate volatility and oxygen is the least volatile. In order to enable high recovery of the individual components, the lower pressure column is operated at as low a pressure as possible, generally about 2 pounds per square inch (psi) above atmospheric pressure. This low pressure enables the relative volatilities between argon and oxygen and between nitrogen and argon to be as large as possible thus maximizing the separation of the air into the three components.

If nitrogen at moderate pressure is desired, the lower pressure column could be operated at a pressure above the conventional low pressure. However, this would result in a significant decrease in argon recovery because a significant amount of the argon would exit the process with the nitrogen rather than being passed to the crude argon column. Moderate pressure nitrogen is becoming in increasingly greater demand for such uses as blanketing, stirring, and enhanced oil recovery. Furthermore, production of moderate pressure nitrogen in conjunction with argon is increasing in importance as oxygen-argon air separation plants, originally built for the steel industry, are experiencing reduced utilization.

It is therefore very desirable to have an air separation process which can produce nitrogen at higher than conventional pressures while also enabling high argon recovery.

Accordingly, it is an object of this invention to provide an air separation process and apparatus for producing moderate pressure nitrogen while producing argon with high recovery.

SUMMARY OF THE INVENTION

The above and other objects which will become apparent to one skilled in the art upon a reading of this disclosure are attained by the present invention, one aspect of which is:

An air separation process comprising:

(A) introducing feed air into a first column operating at a pressure within the range of from 60 to 300 psia and separating the feed within said first column into nitrogen-richer and oxygen-richer components;

(B) passing oxygen-richer and nitrogen-richer component from the first column into a second column operating at a pressure less than that of the first column and within the range of from 20 to 90 psia, for separation into nitrogen-rich and oxygen-rich components;

(C) recovering nitrogen-rich component as moderate pressure nitrogen product;

(D) passing argon-containing fluid from an intermediate point of the second column into a third column and separating the argon containing fluid within the third column into argon richer vapor and oxygen-richer liquid;

(E) recovering a first portion of the argon-richer vapor as crude argon product; and (F) condensing a second portion of the argon-richer vapor by indirect heat exchange with oxygen-rich component and passing resulting liquid down the third column as reflux liquid.

Another aspect of the present invention is:

(A) a first column having feed introduction means;

(B) a second column having fluid recovery means;

(C) means to pass fluid from the first column into the second column;

(D) means to pass fluid from an intermediate point of the second column into a third column equipped with a top condenser and having fluid recovery means; and (E) means to pass fluid from the lower portion of the second column to the top condenser of the third column.

The term, "column", as used herein means a distillation or fractionation column or zone, i.e., a contacting column or zone wherein liquid and vapor phases are countercurrently contacted to effect separation of a fluid mixture, as for example, by contacting of the vapor and liquid phases on a series of vertically spaced trays or plates mounted within the column or alternatively, on packing elements with which the column is filled. For a further discussion of distillation columns see the Chemical Engineers' Handbook. Fifth Edition, edited by R. H. Perry and C. H. Chilton, McGraw-Hill Book Company, New York, Section 13, "Distillation" B. D. Smith, et al., page 13-3 *The Continuous Distillation Process.* The term, double column is used to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation.

The term "indirect heat exchange", as used herein means the bringing of two fluid streams into heat exchange relation without any physical contact or intermixing of the fluids with each other.

As used herein, the term "reboiler" means a heat exchange device which generates column upflow vapor from column bottom liquid.

As used herein, the term "condenser" means a heat exchange device which generates column downflow liquid from column top vapor.

DETAILED DESCRIPTION

The process and apparatus of the present invention will be described in detail with reference to the Drawings.

Figure 1:
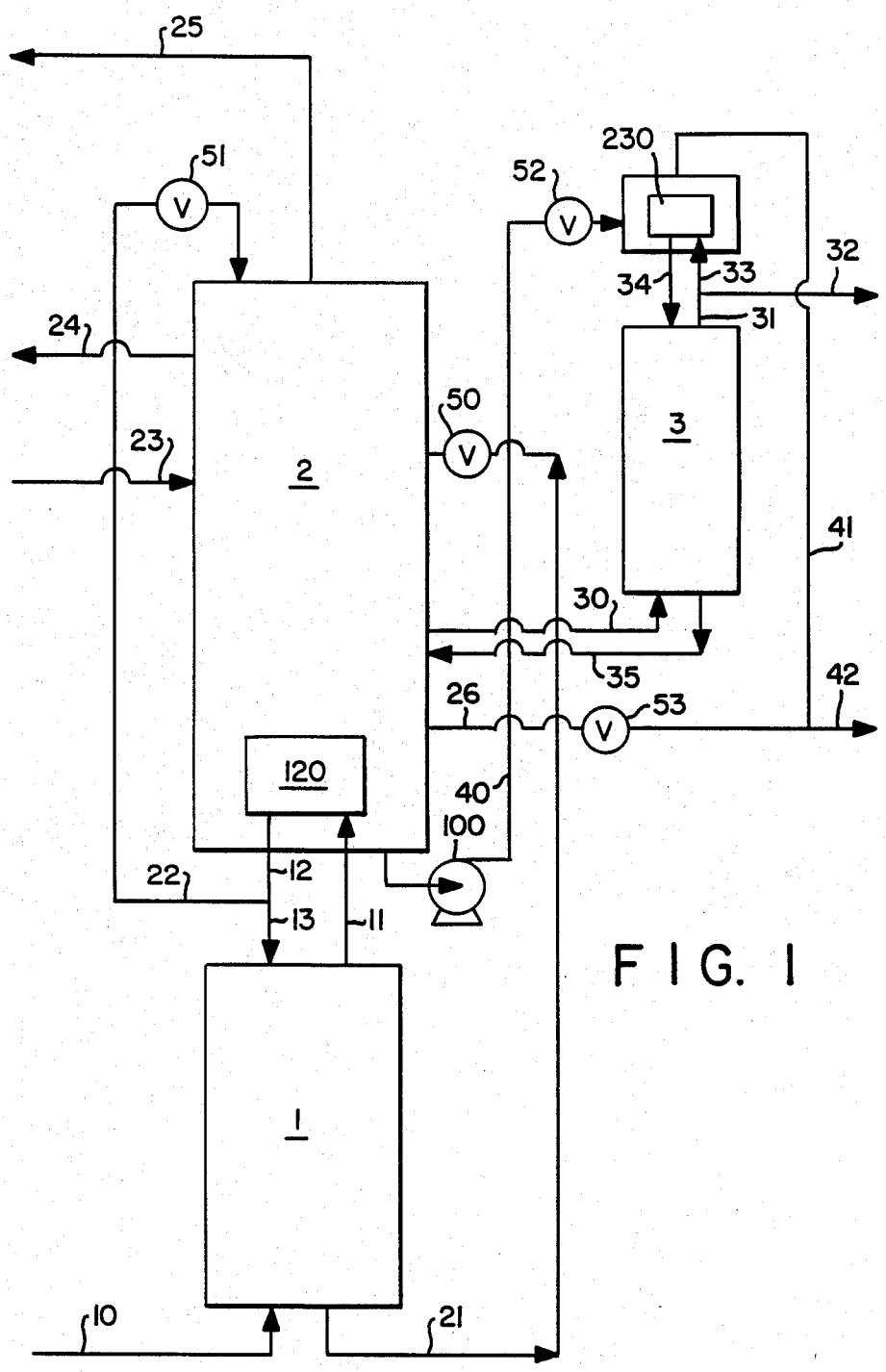
FIG. 1 is a schematic representation of one preferred embodiment of the invention wherein the argon-containing fluid is passed from the second column into the third column as a vapor.

Referring now to FIG. 1, cool, clean feed air 10 is is passed into first column 1 which is operating at a pressure within the range of from 60 to 300 pounds per square inch absolute (psia), preferably within the range of from 80 to 150 psia. Within first column 1 the feed is separated into nitrogen-richer and oxygen-richer components. Oxygen-richer component is passed through conduit 21 and valve 50 into second column 2 which is operating at a pressure less than that of column 1 and within the range of from 20 to 90 psia, preferably within the range of from 20 to 60 psia, most preferably within the range of from 20 to 45 psia. FIG. 1 illustrates a preferred embodiment wherein the first and second columns are in heat exchange relation at main condenser 120 so as to form a double column. In this arrangement nitrogen-richer component 11 is passed as vapor to main condenser 120 and condensed by heat exchange with reboiling second or lower pressure column 2 bottoms. Optionally, a small, generally less than 15 percent, portion of stream 11 may be removed from the column section and recovered as high pressure nitrogen product. The resulting condensed nitrogen-richer component 12 is passed in part as stream 13 down column 1 as reflux and in part through conduit 22 and valve 51 into column 2. If desired, additional feed air vapor 23, such as from a refrigeration-generating turbine expansion, may be added into second column 2.

Within column 2 the nitrogen-richer and oxygen-richer components and optional feed 23 are separated into nitrogen-rich and oxygen-rich components. Nitrogen-rich component 25 is recovered from the upper portion of column 2 having a purity of at least 99.5 percent and at essentially the operating pressure of column 2. The percentages used herein are in mole percent unless otherwise specified. Small nitrogen waste stream 24 is also removed from column 2 for nitrogen purity control purposes.

Argon-containing fluid is passed as vapor from an intermediate point of column 2 through conduit 30 and into third column 3 having a top condenser 230 and which is operating at a pressure similar to that of column 2. The argon-containing fluid generally has an argon concentration within the range of from 8 to 20 percent, with the remainder comprised substantially of oxygen and with about 0.1 percent or less nitrogen. Within column 3 the argon-containing fluid is separated into argon-richer vapor and oxygen-richer liquid. A first portion 32 of argon-richer vapor 31 is recovered as crude argon having an argon concentration generally within the range of from 95 to 99.5 percent. A second portion 33 of the argon-richer vapor is passed to top condenser 230 wherein it is condensed. Resulting liquid 34 is passed down column 3 as reflux. Oxygen-richer liquid is passed from the lower portion of column 3 as stream 35 into and down column 2.

Top condenser 230 is driven by vaporizing oxygen-rich component taken from the lower portion of lower pressure column 2. As shown in FIG. 1, oxygen-rich component 40 is taken as liquid from column 2, expanded through valve 52 and passed into top condenser 230 wherein it vaporizes, at a temperature lower than the temperature at the bottom of column 2 due to its lower pressure, and condenses the argon-richer vapor 33. Depending on the pressure and elevation difference between the column 2 liquid bottoms and the condensor 230 boiling side, the column 2 liquid bottoms pressure may be increased by liquid pump 100. Preferably stream 40 comprises at least 80 percent of the oxygen product produced by the process.

The resulting vapor 41 is passed out of the process and may be recovered as oxygen product 42. Stream 40, prior to vaporization has an oxygen purity of at least 99 percent, preferably at least 99.5 percent. Conveniently stream 41 may be combined with oxygen stream 26 taken from column 2 and passed through valve 53 prior to recovery. Oxygen stream 26 is employed for process control purposes and is typically within the range of from 3 to 10 percent, and preferably is about 5 percent, of the oxygen product 42. Optionally vapor stream 41 may be used to subcool liquid stream 40 prior to the liquid expansion through valve 52 and the combination of stream 41 with stream 26.

The invention enables the recovery in stream 32 of at least 70 percent and up to about 97 percent of the argon within the feed air while simultaneously enabling the recovery of high purity nitrogen at higher than conventional pressure. The invention accomplishes this very advantageous result by driving the crude argon top condenser, not with higher pressure column bottoms as with conventional processes, but with lower pressure column bottoms. Since higher pressure column bottoms need not be used to drive condenser 230, a greater than conventional amount may be passed as stream 21 into the lower pressure column serving to favorably force argon downward toward the intermediate point from which argon-containing stream 30 is taken. Essentially, the favorable effect on argon recovery is due to the added liquid downflow within the lower sections of column 2.

Thus, in spite of the fact that the lower pressure column is operated at higher than conventional pressures thus making argon separation more difficult because of the reduction in relative volatilities, high argon production is achieved because the defined elements of the invention serve to drive argon out of the lower pressure column and into the third column from which it is recovered as crude argon.

Generally more than 70 percent of the feed air introduced into the columns in stream 10 and optional stream 23 is recovered as high purity nitrogen in stream 25. Generally the vapor to liquid feed ratio for the lower pressure column, i.e. the molar ratio of stream 23 to the combination of streams 21, 22 and 35 is less than 0.35 and preferably is within the range of from 0 to 0.15. This further enables argon to be driven downward from the top portion of the lower pressure column where it would go with the nitrogen to the intermediate point where it can be passed to the crude argon column.

Figure 2:
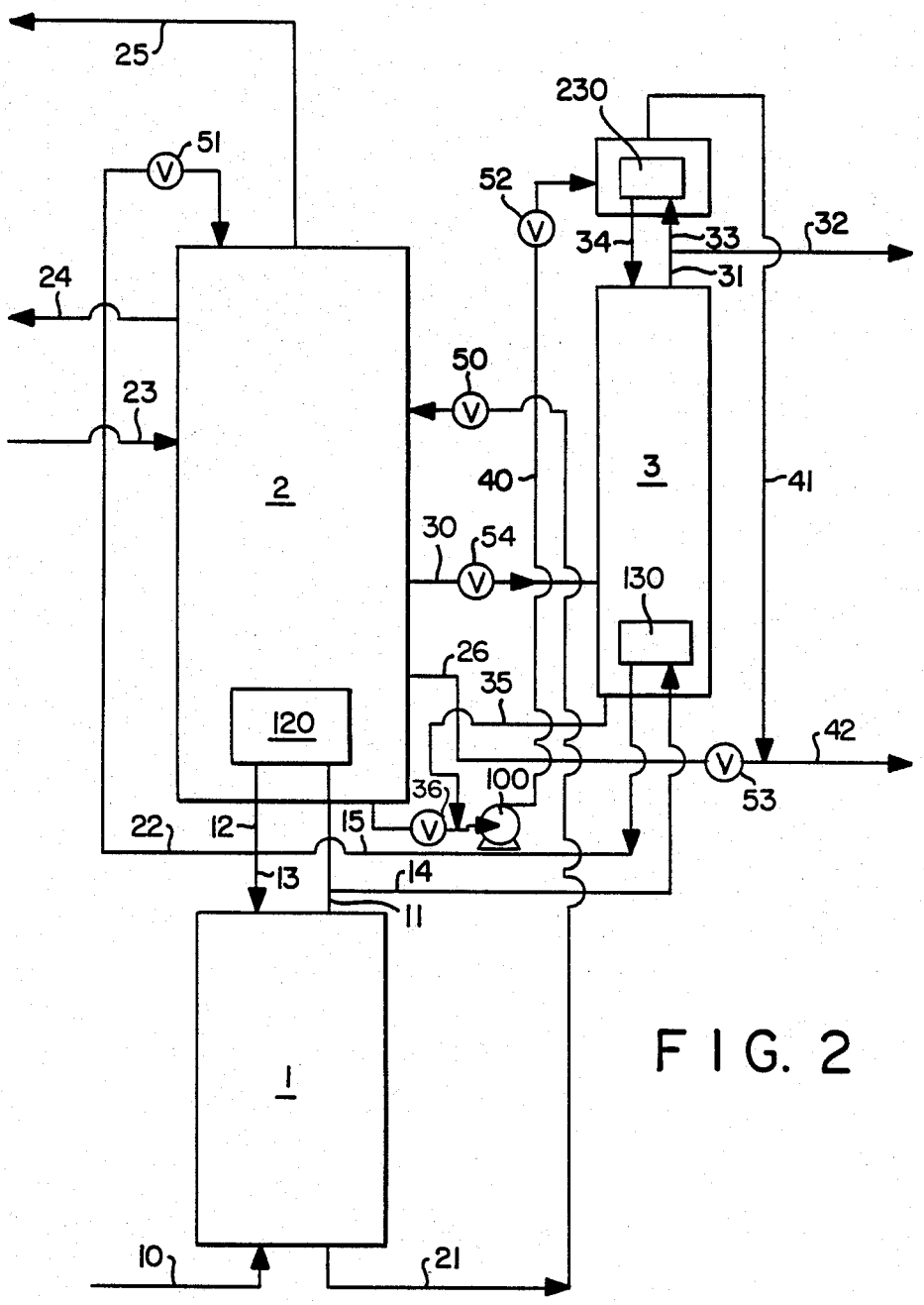
FIG. 2 is a schematic representation of one preferred embodiment of the invention wherein the argon-containing fluid is passed from the second column into the third column as a liquid.

As mentioned previously, the embodiment of the invention illustrated in FIG. 1 is preferred when the argon-containing fluid is passed from the second to the third column as vapor. When this fluid is passed as liquid, the embodiment of the invention illustrated in FIG. 2 is preferred. The numerals of FIG. 2 correspond to those of FIG. 1 for the common elements and for the sake of simplicity only those aspects which differ from the previously discussed embodiment will be discussed in detail.

In the embodiment illustrated in FIG. 2, third column 3 may be, and preferably is, operated at a pressure less than that of the lower pressure column 2. Argon-containing fluid is passed as liquid through conduit 30 and valve 54 into third column 3 wherein it is separated into argon-richer vapor and oxygen-richer liquid. Column 3 additionally comprises bottom reboiler 130 which serves to reboil the column bottoms to generate vapor upflow. Reboiler 130 is driven by a portion 14 of nitrogen-richer component 11 which condenses to effect the reboiling. The resulting condensed portion 15 is combined with stream 12 and passed into either column 2 as part of stream 22 or column 1 as part of stream 13. Oxygen-rich component is first expanded through valve 36 prior to passage to top condenser 230. Finally, oxygen-rich liquid 35 taken from the lower portion of column 3 is not passed into column 2 but rather is passed into the oxygen-rich component stream 40 downstream of valve 36 and upstream of pump 100.

As can be seen, the liquid feed embodiment illustrated in FIG. 2 retains the essential elements of the invention whereby argon is driven out of column 2 and into column 3 despite the higher than conventional pressures at which column 2 is operated.

In Table 1 there is tabulated the results of a computer simulation of the invention carried out with the embodiment illustrated in FIG. 1. The stream numbers of Table 1 correspond to those of FIG. 1, flow is reported in cubic feet per hour at normal temperature and pressure, pressure is in psia, temperature is in degrees Kelvin, and composition is in mole percent unless otherwise indicated. The vapor to liquid feed ratio to column 2, i.e. to mole ratio of stream 23 to the total of streams 21,22 and 35 was 0.065. The oxygen recovery was 99.9 percent, the nitrogen recovery was 94.6 percent and the argon recovery was 92.7 percent. Blank spaces in the Table 1 indicate that the data was not available.

Now by the use of the present invention one can simultaneously produce high purity nitrogen at moderate pressure and crude argon with high recovery.

Although the present invention has been discussed in detail with reference to two specific preferred embodiments, those skilled in the art will recognize that there are additional embodiments of the invention within the spirit and scope of the claims.

I claim:

1. An air separation process comprising:

(A) introducing feed air into a first column operating at a pressure within the range of from 60 to 300 psia and separating the feed within said first column into nitrogen-richer and oxygen-richer components;

(B) passing oxygen-richer and nitrogen-richer component from the first column into a second column operating at a pressure less than that of the first column and within the range of from 20 to 90 psia, for separation into nitrogen-rich and oxygen-rich components;

(C) recovering nitrogen-rich component as moderate pressure nitrogen product;

(D) passing argon containing fluid from an intermediate point of the second column into a third column and separating the argon-containing fluid within the third column into argon-richer vapor and oxygen-richer liquid;

(E) recovering a first portion of the argon-richer vapor as crude argon product; and (F) condensing a second portion of the argon-richer vapor by indirect heat exchange with oxygen-rich component and passing resulting liquid down the third column as reflux liquid.

2. The process of claim 1 wherein nitrogen-richer component from the first column is condensed to vaporize oxygen-rich liquid, a first part of the resulting nitrogen-richer component is passed into the first column and a second part is passed into the second column.

3. The process of claim 1 further comprising introduction of feed vapor into the second column.

4. The process of claim 1 wherein the molar ratio of the vapor to liquid feeds into the second column is less than 0.35.

5. The process of claim 1 wherein the moderate pressure nitrogen product is recovered at a purity of at least 99.5 percent.

6. The process of claim 1 wherein the crude argon product comprises at least 70 percent of the argon in the feed air.

7. The process of claim 1 wherein the argon-containing fluid is passed from the second column into the third column as vapor.

TABLE 1

| | | | | COMPOSITION | | |
|---|---|---|---|---|---|---|
| STREAM No. | FLOW | PRESSURE | TEMP. | OXYGEN | ARGON | NITROGEN |
| 10 | 92.7 | 117.9 | 109.3 | | | |
| 23 | 7.3 | 30.4 | 95.3 | | | |
| Air Feed | 100 | | | 21.0 | 0.9 | 78.1 |
| 21 | 52.9 | 117.9 | | | | |
| 22 | 39.7 | 115.3 | | 2 ppm | 189 ppm | 99.88 |
| 30 | 20.2 | 31.4 | 97.6 | 84.50 | 15.45 | 0.05 |
| 35 | 19.3 | 31.4 | 97.6 | | | |
| 25 | 73.9 | 27.7 | 83.2 | 1 ppm | | >99.98 |
| 32 | 0.9 | 27.3 | 93.6 | 1.9 | 97.3 | 0.8 |
| 42 | 21.0 | 18.2 | 92.6 | 99.75 | 0.25 | 0 |

8. The process of claim 7 further comprising passing oxygen rich liquid from the lower portion of the third column into the second column at an intermediate point of the second column.

9. The process of claim 1 further comprising recovery of oxygen as product.

10. The process of claim 9 wherein the product oxygen is taken from either or both of (a) the oxygen-rich component which serves to condense argon-richer vapor, or (b) the second column.

11. The process of claim 1 wherein the argon-containing fluid is passed from the second column into the third column as liquid.

12. The process of claim 11 wherein the third column is operated at a pressure less than that at which the second column is operated.

13. The process of claim 11 further comprising passing oxygen-rich liquid from the lower portion of the third column into heat exchange relation with argon-richer vapor.

14. The process of claim 11 further comprising reboiling oxygen-rich liquid at the bottom of the third column by indirect heat exchange with condensing nitrogen richer component from the first column.

15. Apparatus for air separation comprising:

(A) a first column having feed introduction means;

(B) a second column having fluid recovery means;

(C) means to pass fluid from the first column into the second column;

(D) means to pass fluid from an intermediate point of the second column into a third column equipped with a top condenser and having fluid recovery means; and (E) means to pass fluid from the lower portion of the second column to the top condenser of the third column.

16. The apparatus of claim 15 further comprising a main condenser within the lower portion of the second column, means to pass vapor from the upper portion of the first column to the main condenser, and means to pass liquid from the main condenser to the upper portion of the first column.

17. The apparatus of claim 15 further comprising means to pass fluid from the lower portion of the third column into the second column at an intermediate point of the second column.

18. The apparatus of claim 15 further comprising means to introduce vapor feed into the second column.

19. The apparatus of claim 15 further comprising means to pass fluid from the lower portion of the third column to the top condenser.

20. The apparatus of claim 19 further comprising a reboiler in the lower portion of the third column, means to pass vapor from the upper portion of the first column to the reboiler, and means to pass liquid from the reboiler to the upper portion of the first column.

* * * * *

UNITED STATES PATENT AND TRADEMARK OFFICE

CERTIFICATE OF CORRECTION

PATENT NO. : 4,822,395

DATED : April 18, 1989

INVENTOR(S) : Harry Cheung

It is certified that error appears in the above-identified patent and that said Letters Patent is hereby corrected as shown below:

In column 3, line 24 delete "is" second occurrence.

In column 5, lines 30 and 31 delete "oxygen-rich" and insert therefor --oxygen-richer--.

In column 5, line 47 delete "to" third occurrence and insert therefor --the--.

In claim 8, line 2 delete "oxygen rich" and insert therefor --oxygen-richer--.

In claim 13, line 2 delete "oxygen-rich" and insert therefor --oxygen-richer--.

In claim 14, line 2 delete "oxygen-rich" and insert therefor --oxygen-richer--.

Signed and Sealed this

Nineteenth Day of December, 1989

*Attest:*

JEFFREY M. SAMUELS

*Attesting Officer* *Acting Commissioner of Patents and Trademarks*